US007516694B1

(12) United States Patent
Eifler

(10) Patent No.: US 7,516,694 B1
(45) Date of Patent: Apr. 14, 2009

(54) FIREWOOD BUNDLER DEVICE

(76) Inventor: Scott M. Eifler, W. 2178 Pond Rd., Neosho, WI (US) 53059

( * ) Notice: Subject to any disclaimer, the term of this patent is extended or adjusted under 35 U.S.C. 154(b) by 0 days.

(21) Appl. No.: 11/894,199

(22) Filed: Aug. 21, 2007

(51) Int. Cl.
*B65B 13/10* (2006.01)

(52) U.S. Cl. ..... 100/27; 100/7; 53/211; 53/441; 53/556; 53/588; 53/592

(58) Field of Classification Search ..... 100/1, 100/7, 8, 9, 12, 13, 27; 53/210, 211, 441, 53/556, 587, 588, 592; 144/192
See application file for complete search history.

(56) References Cited

U.S. PATENT DOCUMENTS

| | | | | |
|---|---|---|---|---|
| 2,945,336 | A * | 7/1960 | Anderson et al. | 53/588 |
| 3,820,451 | A * | 6/1974 | Tanaka | 100/4 |
| 3,939,762 | A | 2/1976 | Smitherman et al. | |
| 4,072,094 | A | 2/1978 | Smitherman et al. | |
| 4,079,565 | A | 3/1978 | Lancaster, III et al. | |
| 4,166,348 | A * | 9/1979 | Carlson | 53/556 |
| 4,317,322 | A * | 3/1982 | Lancaster et al. | 53/399 |
| 4,377,362 | A | 3/1983 | Meinke | |
| 4,658,570 | A | 4/1987 | Thomas | |
| 4,829,750 | A | 5/1989 | Cassidy | |
| 4,949,533 | A | 8/1990 | Bate | |
| 5,243,901 | A | 9/1993 | Green | |
| 5,673,524 | A | 10/1997 | Vartanian et al. | |

* cited by examiner

*Primary Examiner*—Jimmy T Nguyen
(74) *Attorney, Agent, or Firm*—Tipton L. Randall

(57) ABSTRACT

A firewood bundler device includes a base member having first and second opposed, vertical arm members extending from the base member. A U-shaped, wood support member is attached at an end of each arm member, with an open end opposite the base member. A wrapping support member is rotatably attached to an end of one arm member and includes a spindle section extending therefrom, the spindle section movable in a circular path around the wood support members upon rotation of the wrapping support member. The spindle section holds a roll of wrapping material. A rotation device is operatively connected to the wrapping support member for imparting rotational movement thereto and to the spindle section. Multiple pieces of firewood placed in the U-shaped supports are encircled with wrapping material by rotation of the wrapping support member holding a roll of wrapping material.

5 Claims, 7 Drawing Sheets

FIREWOOD BUNDLER DEVICE

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a packaging apparatus and, more particularly, to a packaging apparatus for firewood and, most particularly, to a packaging apparatus for producing hand carried bundles of firewood.

2. Background Information

Wood is a common fuel used for heating dwellings and can be burned in furnaces or fireplaces. Additionally, wood fires are built out of doors when camping or just enjoying nature. A wood fire in a fireplace or outdoors fire ring has a certain aesthetic appeal which may date back to early human history. When used for heating dwellings, large quantities of firewood are required. When a wood fire is used for aesthetic appeal, smaller amounts of wood are required. Most individuals do not have a firewood source and prefer to purchase small quantities of firewood, as needed. Because firewood is commonly cut into pieces having lengths of one to two feet, transporting multiple pieces of cut firewood is not an easy task. Thus, there is a demand for a relatively small bundle of cut firewood that is contained within a wrapper, allowing facile transport and handling of the wrapped bundle. Many camp grounds and convenience stores offer such wrapped bundles of cut firewood for sale to the public.

Individuals have developed devices and methods for wrapping or bundling firewood or similar material. Some of these devices have been granted patents, including the following.

Smitherman et al., in U.S. Pat. Nos. 3,939,782 and 4,072,094, describe an apparatus and method for bundling firewood. Relatively large pieces of wood, preferably first split and cut into convenient lengths, are compressed and, while compressed, have a strap applied there around, after which the applied pressure is released to form a bundle of firewood that is tightly banded. The apparatus includes a base section having a pair of spaced upwardly opening U-shaped members upon which the pieces of firewood are stacked with the end portions of the firewood supported by the U-shaped members. A pressure platen section is mounted above the base section and includes a second pair of U-shaped members that are downwardly directed and aligned with the U-shaped members of the base section so that, as the pressure platen is moved downwardly, the pieces of wood there between are compressed. The pressure platen section is moved upwardly and downwardly by a hydraulic ram, and about eight tons of pressure are preferably exerted to compress and contour the wood into a cylindrical bundle. While compressed, a strap or band is applied centrally around the compressed wood bundle. An electro-pneumatic system is utilized to control the sequencing of the apparatus, including automatic actuation of the hydraulic ram and application of the band to the compressed bundle.

Lancaster III, et al., in U.S. Pat. No. 4,079,565, describe an apparatus and process for making a unitary package, which comprises a load that has a band formed of plural layers of a stretched material wrapped around it. The apparatus comprises a frame with a rotatable drive shaft driven by a drive mechanism, an arm secured to the drive shaft and a roll holding shaft rotatably mounted to the arm. A sensor device measures the thickness of a material roll placed on the roll holding shaft to control an electromagnetic brake mechanism mounted on the roll holding shaft to variably engage the roll holding shaft, thus maintaining a constant tension on the film unwrapped from the roll. The steps of the process are placing a load on a support; locating a rolled-up sheet of a stretchable material on a dispenser roll adjacent to the support; withdrawing a leading edge of the material from the dispenser roll and holding the leading edge of the material against the load. Relative movement between the dispenser roll and the support means is initiated, but is restricted so that the material will be stretched, with a sufficient amount of the stretched material being dispensed from the dispenser roll to provide a band comprising plural layers of the stretchable material around the load.

In U.S. Pat. No. 4,166,348, Carlson discloses a tension wrap packaging machine with a supporting frame and a driving assembly mounted in the supporting frame. A main drive shaft is mounted in the supporting frame, and at one end has a combined supporting member and safety closure disc fixedly connected thereto, to be rotated by the drive shaft when the driving assembly is in operation. Mounted and rotatable with the combined supporting member and closure disc are a package supporting assembly for supporting a package to be wrapped thereon, and in spaced relation thereto, a wrapping material supporting assembly for the material to wrap the package. Package supporting assembly and wrapping material supporting assembly, in addition to rotating with the closure disc, are independently rotatable. The package supporting assembly is rotated by a planetary driving means, and the wrapping material supporting assembly is rotated by an auxiliary driving means operatively connected between the driving assembly and wrapping material supporting assembly. The auxiliary driving means includes an adjustable means to regulate the force or tension exerted on the wrapping material to remove it from the dispensing roll supporting assembly when the wrapping material is wrapped around the package on the package supporting assembly. The package supporting assembly includes a means to support packages of varying sizes within a given range. The wrapping material supporting assembly includes, a means to forcibly grip the roll of wrapping material in assembled position thereon and a means to move the roll of wrapping material to and fro along an axis parallel to the axis of rotation of the supporting member.

U.S. Pat. No. 4,377,362 by Meinke describes an apparatus for bundling short lengths of cylindrical items, such as firewood. The apparatus includes a frame for resting on the earth, with a semicircular bottom rack rotatably supported by the frame about its horizontal axis and normally retained in an upper, open position. A semicircular top rack of the same internal dimensions is removably attachable to the bottom rack to form, when the two parts are attached, a circular area in which firewood may be stacked and retained. A band is then secured around the stacked wood, after which the semicircular top rack is removed. A means for rotating the bottom rack about its horizontal axis allows the banded cylindrical bundle of firewood to be removed from the rack.

In U.S. Pat. No. 4,658,570, Thomas discloses a bundling device for bundling elongate articles, such as firewood, with plastic film. The device includes a wood support for fixedly supporting the articles to be bundled, a film support to support a roll of the plastic film to be wrapped around the articles and a drive for rotating the film support around the articles on the wood support to wrap the film around the wood carried on the wood support. The film support includes a brake to maintain tension in the film as it is being wrapped around the articles, the brake increasing the tension in the film when it is desired to break the film after the articles have been wrapped. Note the counterweight 55 and the operating sequence of FIGS. 7-11.

Cassidy, in U.S. Pat. No. 4,829,750, describes a method and apparatus, powered solely by the muscles of a single individual for bundling cut firewood. The apparatus is located under and over the top of a rugged rectangular work bench. The frame is constructed of welded metal reds, about an inch and a quarter in diameter. The operator can load the apparatus onto a flat bed of a motor vehicle for transport over open roads and across country. The operator faces a full length raceway below the top of the long panel. A lever arm protrudes from the raceway toward the operator. A pivot is welded across the raceway, a foot or so back of the panel. A loose-fitting sleeve cover is over the pivot. The lever arm is welded to the loose-fitting sleeve cover, its fulcrum. A chain linkage is welded to an end of the lever arm and to the foot of the elevator rod. The chain linkage forms a loop between the two. As the operator treads downwardly on the lever arm, the chain linkage shortens and, in so doing, drives the elevator rod and its attached elevator rod carriage perpendicularly above the work bench. Before the latter movement starts, the operator places wide resilient rubber bands salvaged from used truck tire inner tubes, over the terminal removeable rods, in removeable rod sleeves, on the elevator rod carriages and under the corresponding fixed (stationary) rods welded to the top of the work bench. He continues to tread down upon the lever arm until he has created sufficient space for the bundle he desires, whereupon, he "captures" the lever arm under the work bench, loads the firewood in the cubic space created by the stretched rubber bands, releases "capture," removes the removeable rods from the rod sleeves, removes the wide rubber bands from under the stationary rods welded to the top of the work bench, and tosses the bundle to the ground.

In U.S. Pat. No. 4,949,533, Bate discloses a machine for band wrapping articles characterized in that it comprises a rotatable support for a supply of wrapping material, which preferably is a hydrophobic film of resiliently stretchable plastics material. An adjustable support for the article to be wrapped comprises two or more support members movable relative to each other. A means for enabling the wrapping material to be wrapped round both the support members and the article is present. The means also enables the material during its travel from the supply to the article (i) to be maintained under tension and (ii) to be reciprocated at right angles to the direction of travel of the material during the wrapping operation. The support members are removed from between the wrapping material and the article. Preferred members are smooth flat plates or blades, the surface of which has been treated with an antifriction agent, for example, polytetrafluoroethylene.

Green, in U.S. Pat. No. 5,243,901, describes a bundling and banding machine that forms and bands bundles of firewood into the shape of a stable wood pile. The resulting wood pile can be easily removed from the machine, transported as a banded bundle and, when deposited at its final destination, the bands are removed, and it stands as a stable wood pile, with a minimum of distortion or need of restacking. The bundle can be of several shapes, such as circular, rectangular, square or triangular.

In U.S. Pat. No. 5,673,542, Vartanian et al. disclose an apparatus for wrapping one or more variously-sized articles from a roll of web material, e.g., elastic plastic material, by supporting the articles on an adjustable support assembly while orbitally rotating the web material roll around the articles. A preferred apparatus is characterized by an article support assembly comprising a pair of arms at substantially right angles each having a plurality of elongated V-shaped fingers adjustably positioned on the arms and extending at substantially right angles to the arms, wherein one or more articles are supported by said fingers during a wrapping operation.

Applicant has devised a firewood bundling device that is easily operated by a single individual and overcomes many of the shortcomings of the above described devices.

SUMMARY OF THE INVENTION

The invention is directed to a firewood bundler device adapted for wrapping a bundle of firewood. The firewood bundler device includes a base member having first and second opposed, vertical arm members, extending from a common side of the base member and forming a work space there between. A U-shaped wood support member is attached at an end of each arm member opposite the base member. Each wood support member extends into the work space and has an open end opposite the base member. The wood support members form a cradle area within the work space. A wrapping support member is rotatably attached to an end of one arm member opposite the base member and is rotatable within the work space. The wrapping support member includes a spindle section extending therefrom, the spindle section movable in a circular path around the cradle area of the wood support members upon rotation of the wrapping support member. The spindle section is adapted for holding a roll of wrapping material. A rotation device is operatively connected to the wrapping support member for imparting rotational movement thereto and to the spindle section extending therefrom. Multiple pieces of firewood are placed in the cradle area of the U-shaped supports, with the ends of the pieces resting on each U-shaped wood support. The pieces of firewood are encircled with wrapping material by rotation of the wrapping support member holding a roll of wrapping material by the rotation device.

In a preferred embodiment of the invention, the wrapping support member includes a circular disk member with a counter weight member attached opposite the spindle section. Preferably, the rotation device includes a motor member and drive mechanism, operatively connected to the wrapping support member, with a foot control switch for controlling operation of the motor member and drive mechanism. The spindle section also includes a spring and nut assembly adapted for imparting tension on the roll of wrapping material.

DESCRIPTION OF THE EMBODIMENTS

Nomenclature

| | |
|---|---|
| 10 | Firewood Bundler Device |
| 15 | Base Member |
| 17 | Leg Sections of Base Member |
| 18 | Crossbar Section of Base Member |
| 20 | First Opposed Arm Member |
| 25 | Second Opposed Arm Member |
| 30 | U-Shaped Wood Support Member |
| 35 | U-Shaped Wood Support Member |
| 40 | Mounting Peg of Wood Support Member |
| 45 | Open End of Wood Support Member |
| 50 | Wrapping Support Member |
| 55 | Spindle Section of Wrapping Support Member |
| 60 | Counter Weight of Wrapping Support Member |
| 65 | Motor Member |
| 70 | Drive Mechanism |
| 75 | Handle Member |
| 80 | Guard Member |
| 85 | Expanded Metal Section of Guard Member |
| 90 | Mounting Base Section of Guard Member |
| 95 | Motor Support Platform |
| 100 | Foot Control Switch for Motor Member |
| 110 | Spring and Nut Assembly of Spindle Section |
| C | Cradle Area |
| F | Firewood Pieces |
| S | Work Space |
| W | Wrapping Material |

Construction

The invention is a firewood bundler device adapted for wrapping a bundle of firewood. The firewood bundler device includes a base member having first and second opposed, vertical arm members, extending from a common side of the base member and forming a work space there between. A U-shaped, wood support member is attached at an end of each arm member opposite the base member. Each wood support member extends into the work space and has an open end opposite the base member. The wood support members form a cradle area within the work space. A wrapping support member is rotatably attached to an end of one arm member opposite the base member and is rotatable within the work space. The wrapping support member includes a spindle section extending therefrom, the spindle section movable in a circular path around the cradle area of the wood support members upon rotation of the wrapping support member. The spindle section is adapted for holding a roll of wrapping material. A rotation device is operatively connected to the wrapping support member for imparting rotational movement thereto and to the spindle section extending therefrom. Multiple pieces of firewood are placed in the cradle area of the U-shaped supports with the ends of the pieces resting on each U-shaped wood support. The pieces of firewood are encircled with wrapping material by rotation of the wrapping support member holding a roll of wrapping material by the rotation device.

Figure 1:
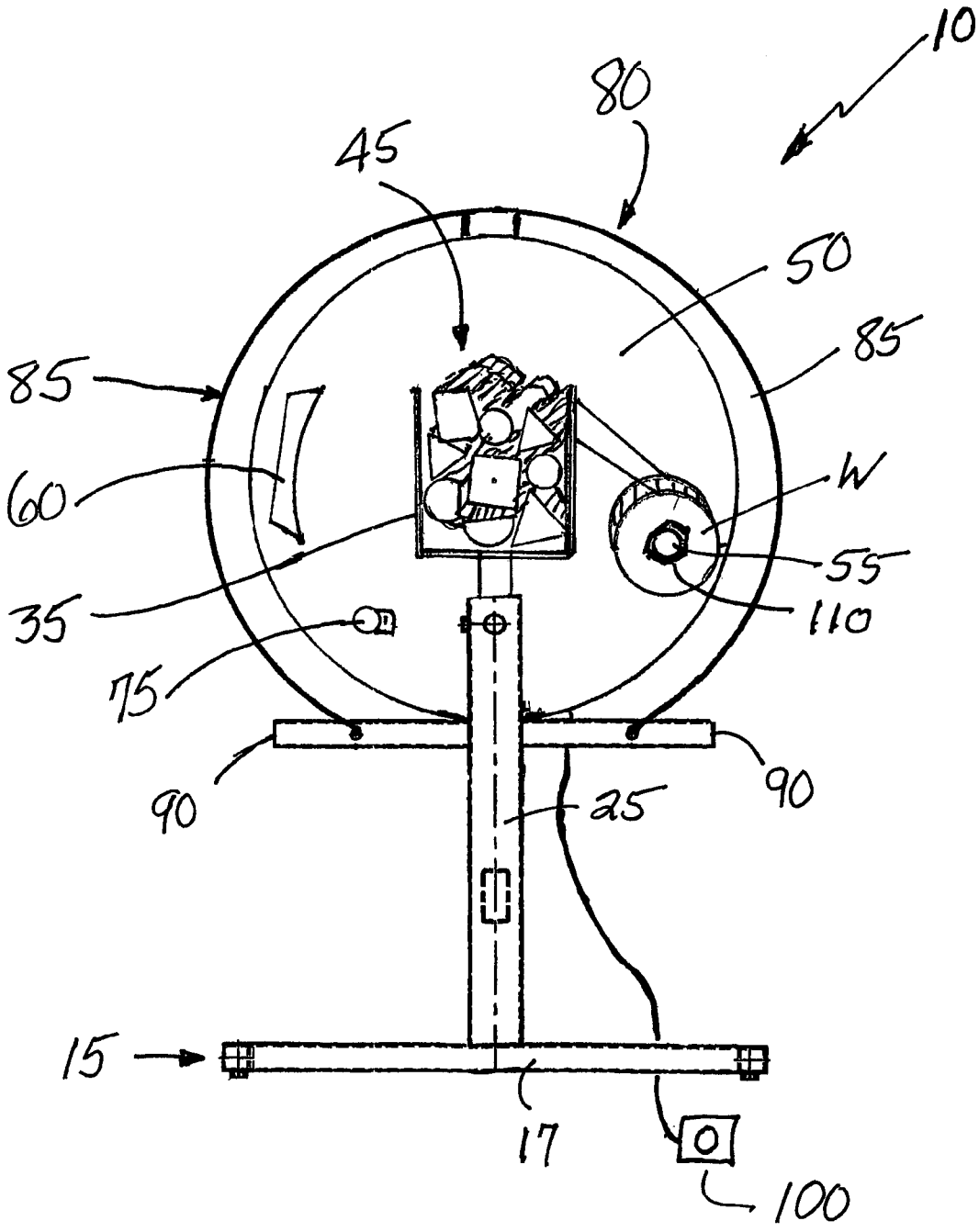
FIG. 1 is a front view of the firewood bundling device of the present invention.
Figure 2:
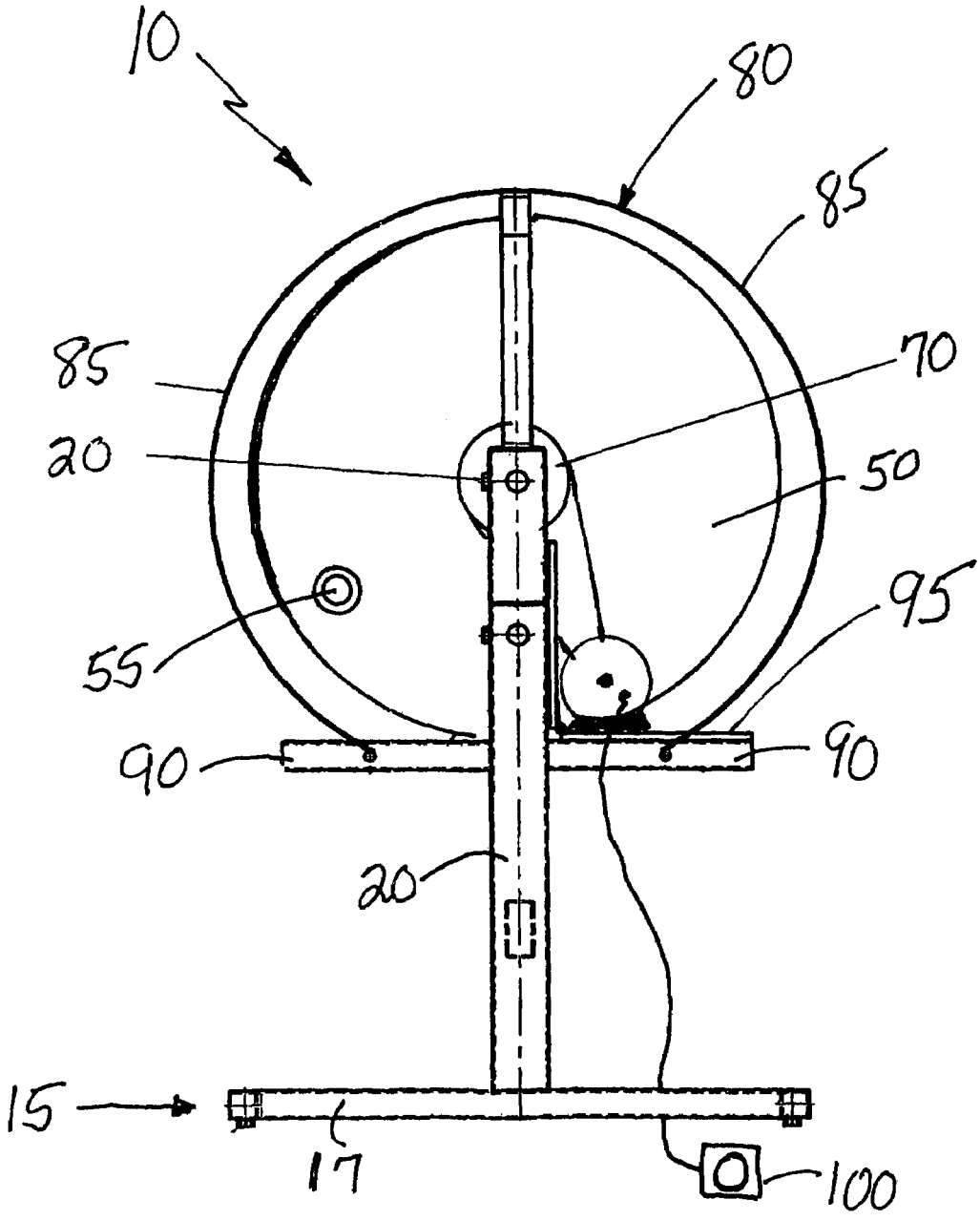
FIG. 2 is a rear view of the firewood bundling device of the present invention.
Figure 3:
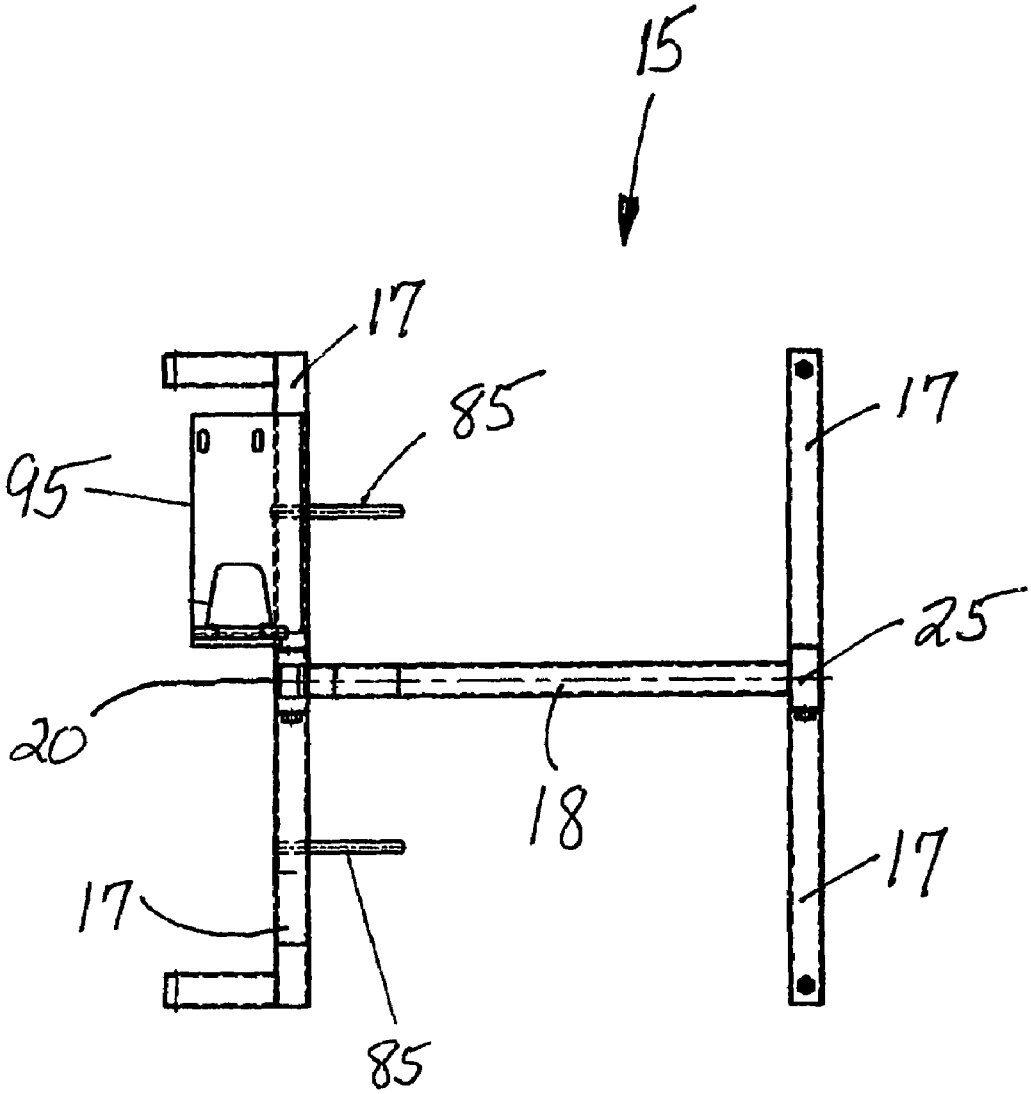
FIG. 3 is a top view of the base member and arm members of the firewood bundling device of the present invention.
Figure 4:
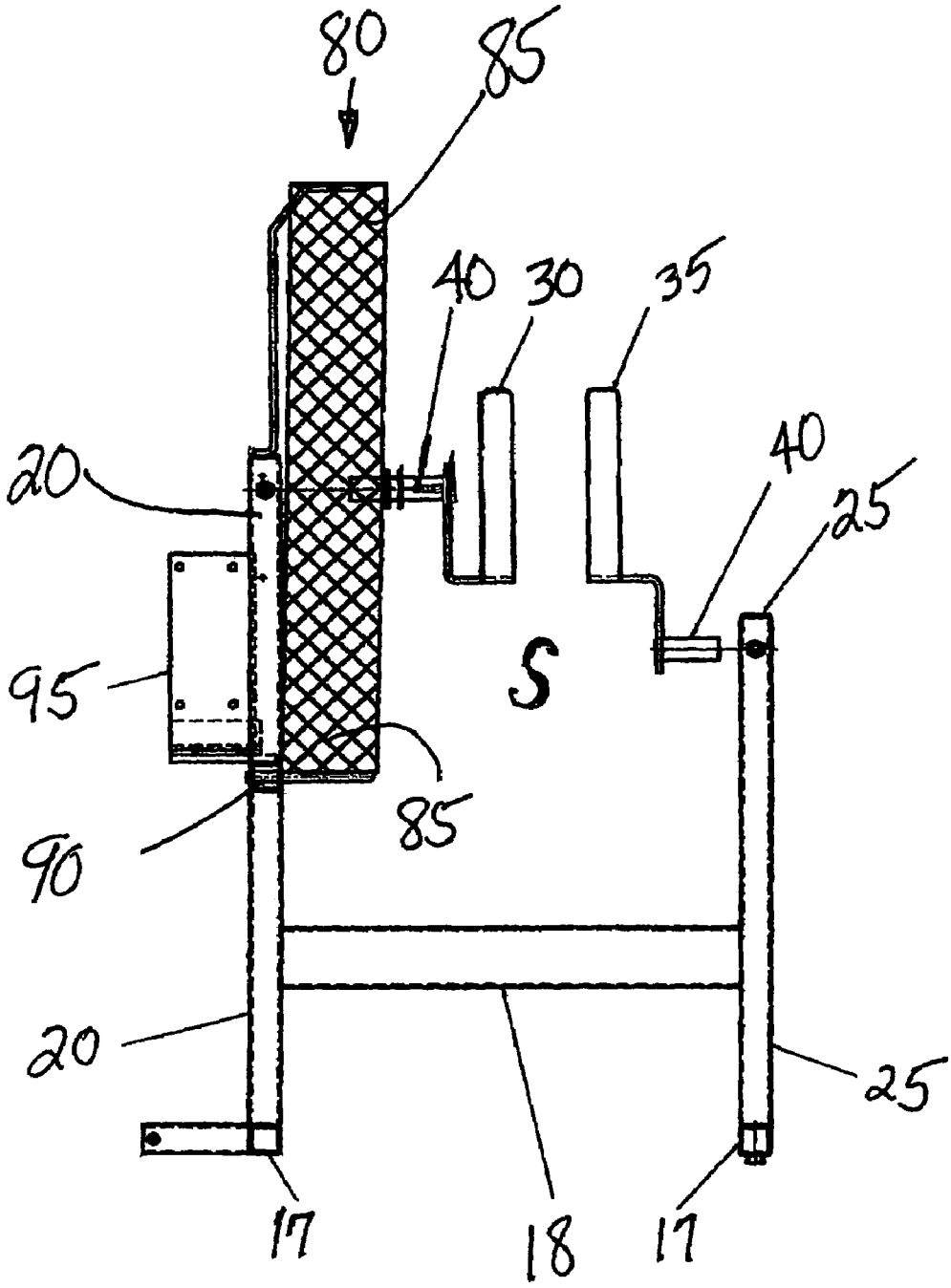
FIG. 4 is a partially exploded side view of the firewood bundling device of the present invention.

Referring now to FIGS. 1-5, one embodiment of the firewood bundler device 10, adapted for wrapping a bundle of firewood, is illustrated. The firewood bundler device 10 includes a base member 15 having first and second opposed, vertical arm members 20, 25 extending from a common side of the base member 15 and forming a work space S there between. Preferably, the base member 15 comprises an H-shaped member 15 with a crossbar section 18 attached between leg sections 17 of the base member 15. The base member 15 is best seen in FIG. 3, a top view of the base member 15 and arm members 20, 25 of the firewood bundler device 10. Each arm member 20, 25 extends from one intersection of the crossbar section 18 and a leg section 17. One of a pair of U-shaped wood support members 30, 35 is attached at an end of each arm member 20, 25 opposite the base member 15. Preferably, each wood support member 30, 35 includes a mounting peg 40 that inserts into an aperture in one arm member 20, 25, allowing for easy mounting and removal of the wood support members 30, 35. Each wood support member 30, 35 extends into the work space S and has an open end 45 that is oriented opposite the base member 15. The wood support members 30, 35 form a cradle area C within the work space S, with the base of the U-shaped wood support members 30, 35 aligned to support firewood pieces F there between.

Figure 5:
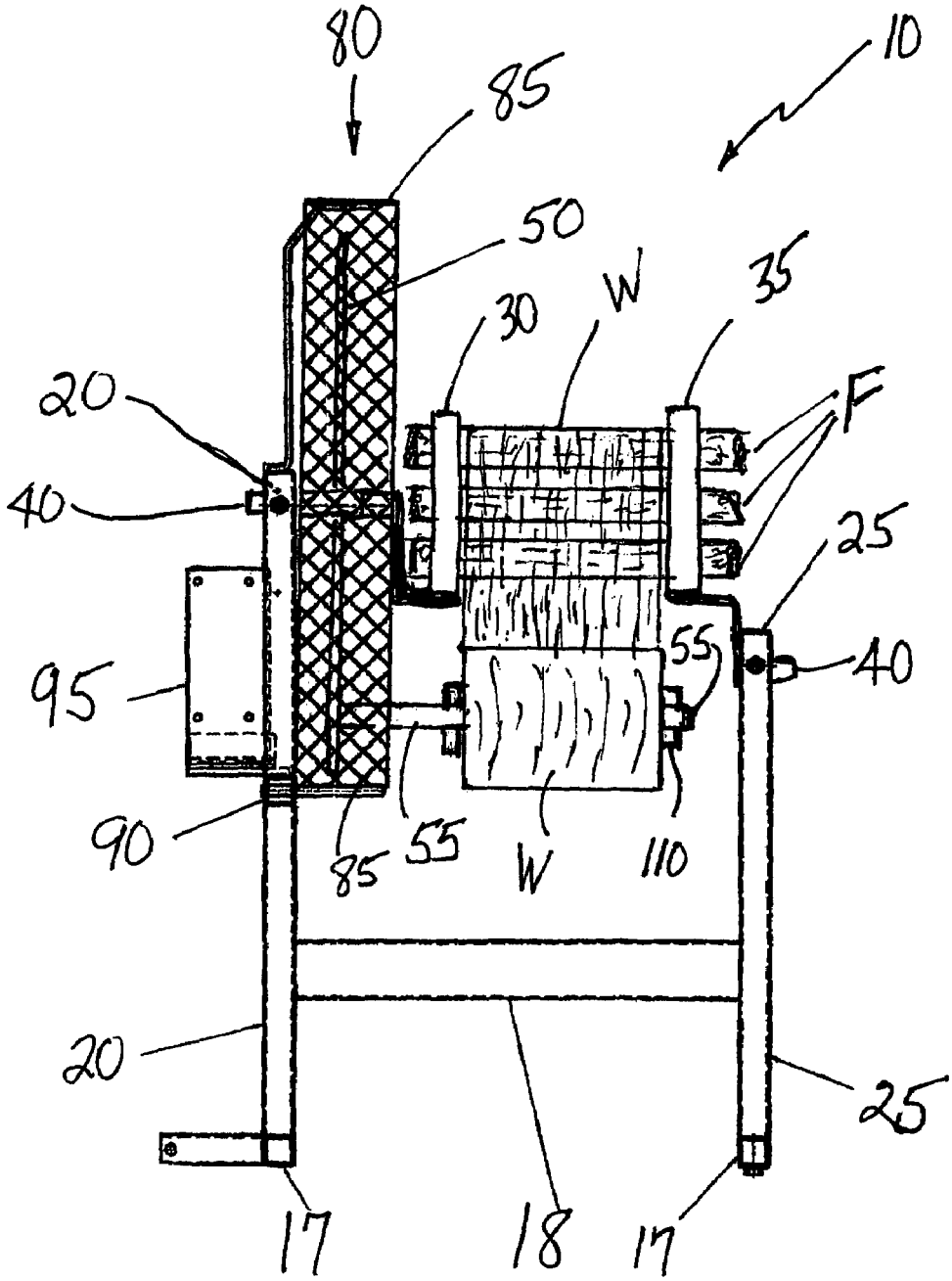
FIG. 5 is a side view of the firewood bundling device of the present invention in operation.
Figure 6:
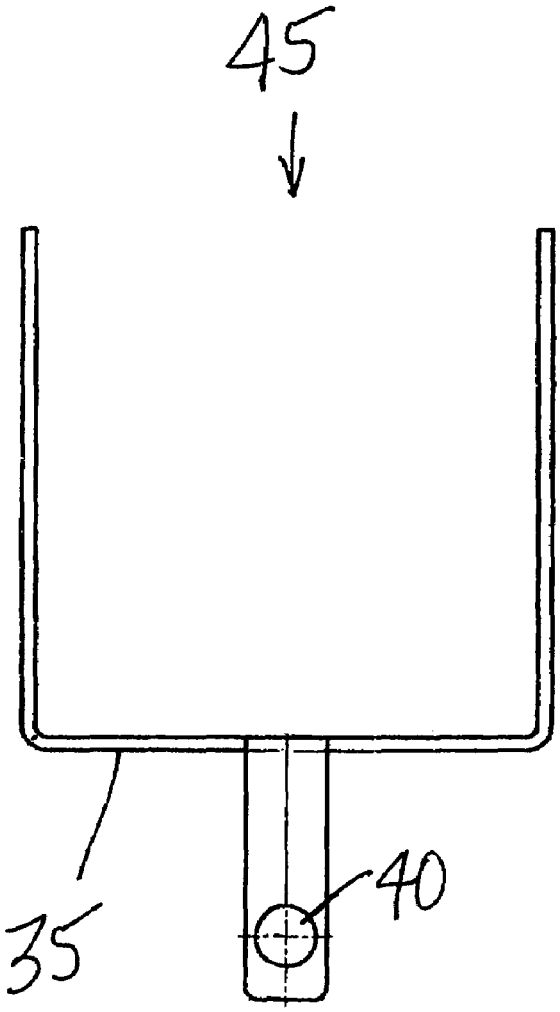
FIG. 6 is an end view of one U-shaped wood support member of the firewood bundling device of the present invention.
Figure 7:
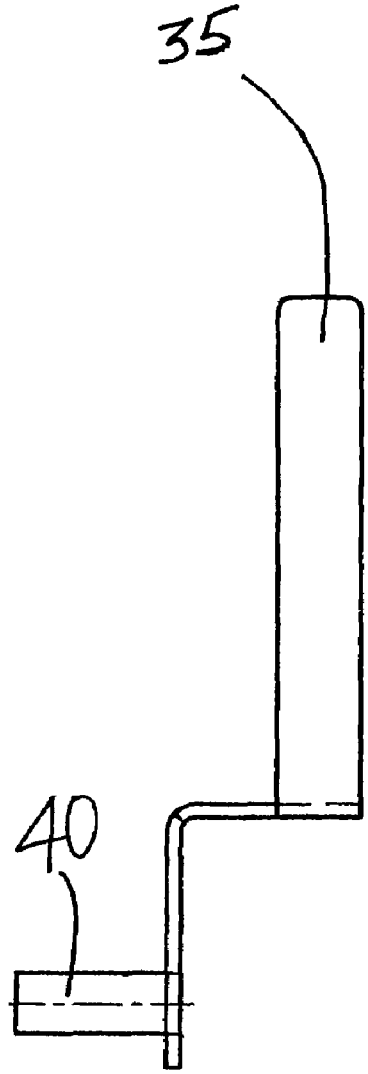
FIG. 7 is a side view of the U-shaped wood support member of FIG. 6 of the firewood bundling device of the present invention.
Figure 8:
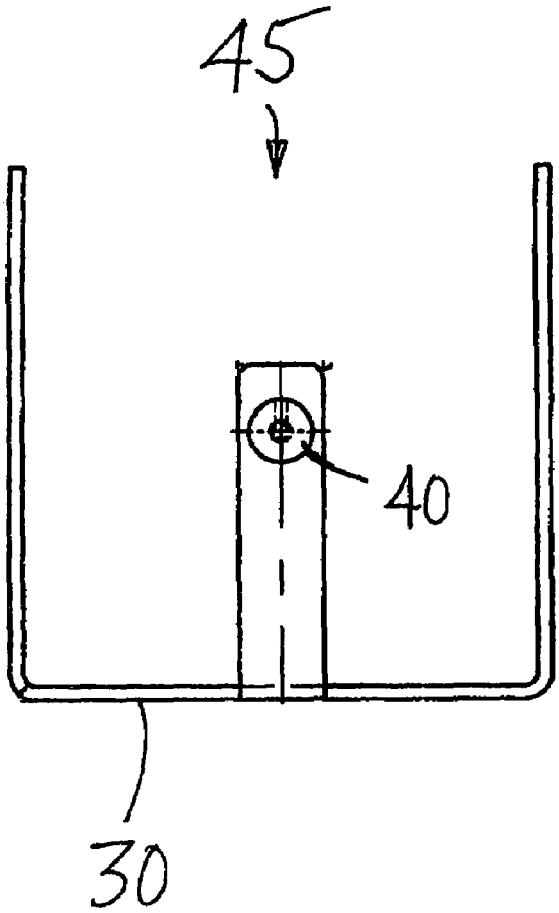
FIG. 8 is an end view of the other U-shaped wood support member of the firewood bundling device of the present invention.
Figure 9:
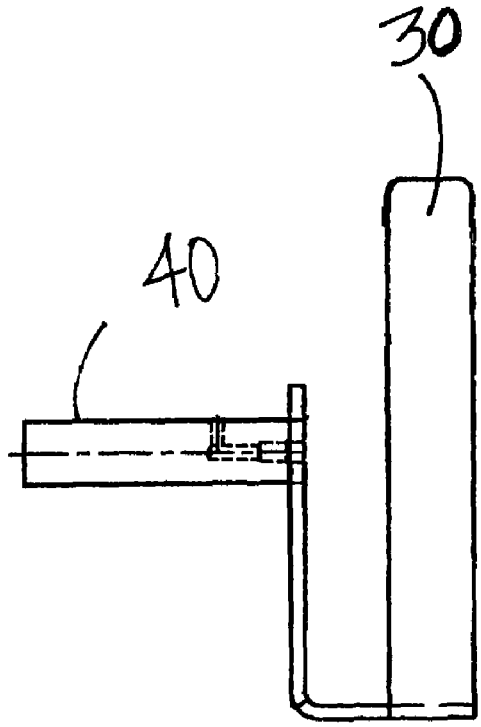
FIG. 9 is a side view of the U-shaped wood support member of FIG. 8 of the firewood bundling device of the present invention.

A wrapping support member 50 is rotatably attached to an end of one arm member 20 opposite the base member 15 and is rotatable within the work space S. The wrapping support member 50 may include a linear bar structure or, preferably, a circular disk member 50, as illustrated in FIGS. 1, 2 and 5. The wrapping support member 50 includes a spindle section 55, extending from the wrapping support member 50, the spindle section 55 movable in a circular path around the cradle area C of the wood support members 20, 25 upon rotation of the wrapping support member 50. The spindle section 55 is adapted for holding a roll of wrapping material W. In a preferred embodiment, the spindle section 55 includes a spring and nut assembly 110, adapted for imparting tension on the roll of wrapping material W.

In a most preferred embodiment, a counter weight member 60 is attached to the wrapping support member 50 opposite the spindle section 55. The counter weight member 60 balances the weight of the roll of wrapping material W mounted on the spindle section 55, allowing for smooth rotation of the wrapping support member 50 during operation of the firewood bundler device 10.

A guard member 80 essentially encircles the wrapping support member 50 and is attached to the arm member 20 supporting the wrapping support member 50. In a preferred embodiment, the guard member 80 includes a cylindrical, expanded metal section 85 attached to a mounting base section 90, which is secured to the arm member 20 supporting the wrapping support member 50. A rotation device is operatively connected to the wrapping support member 50 for imparting rotational movement thereto and to the spindle section 55 extending therefrom. The rotation device can include a simple handle member 75, secured to the wrapping support member 50 for manual rotation thereof. Preferably, the rotation device includes a motor member 65 and drive mechanism 70, operatively connected to the wrapping support member 50. Although any type of motor member 65 and drive mechanism 70 can be employed, an electric motor member 65 coupled with a belt drive mechanism 70 is preferred. The electric motor member 65 is conveniently mounted on a motor support platform 95, secured to the arm member 20 supporting the wrapping support member 50. For convenience, a foot control switch 100 is connected to the electric motor member 65 for control of the motor member 65 by the operator of the device 10.

In operation, multiple pieces of firewood F are placed in the cradle area C of the U-shaped supports 30, 35, with the ends of the pieces F resting on the base of each U-shaped wood support member 30, 35. The multiple pieces of firewood F are encircled with wrapping material W by rotation of the wrapping support member 50 holding the roll of wrapping material W on the spindle section 55. The operator places the end of the wrapping material W on the firewood F and causes the wrapping support member 50 to rotate, thereby moving the spindle section 55 and roll of wrapping material W in a circular path around the cradle area C of the wood support members 20, 25. After multiple layers of wrapping material W encircle the pieces of firewood F, the operator ceases rotation of the wrapping support member 50, cuts the wrapping material W between the firewood bundle F and the roll of wrapping material, and removes the wrapped bundle of firewood F from the U-shaped wood support members 30, 35. The process is then repeated.

The spindle section 55 of the wrapping support member 50 is sized so that the wrapping material W contacts only the pieces of firewood F upon rotation of the wrapping support member 50, as illustrated in FIG. 5. The wrapped bundle of firewood F is readily removed from the U-shaped supports 30, 35. The U-shaped supports 30, 35 securely support the pieces of firewood F and do not contact the wrapping material W during production of the wrapped bundle of firewood F.

While the invention has been particularly shown and described with reference to preferred embodiments thereof, it will be understood by those skilled in the art that various changes in form and details may be made therein without departing from the spirit and scope of the invention.

I claim:

1. A firewood bundler device adapted for wrapping a bundle of firewood, the firewood bundler device comprising:

a base member comprises leg sections;

first and second opposed, vertical arm members, extending from a common side of the base member and forming a work space there between;

a crossbar section attached to the arm members;

a pair of U-shaped wood support members, one attached at an end of each arm member opposite the base member, each of the wood support members includes a horizontally-positioned mounting peg, each of the mounting pegs inserted into an aperture located at an end of the respective arm members, each wood support member extending into the work space and having an open end opposite the base member, the wood support members forming a cradle area within the work space;

a wrapping support member rotatably attached to an end of one of the arm members opposite the base member and rotatable within the work space, the wrapping support member includes a circular disk member, a spindle section extending from the circular disk member, the spindle section movable in a circular path around the cradle area of the wood support members upon rotation of the wrapping support member, the spindle section adapted for holding a roll of wrapping material;

a counter weight member attached to the circular disk member opposite the spindle section;

a guard member essentially encircling the wrapping support member and attached to the arm member supporting the wrapping support member; and a rotation device operatively connected to the wrapping support member for imparting rotational movement thereto and to the spindle section;

whereby multiple pieces of firewood placed in the cradle area of the U-shaped support members, with the ends of the pieces resting on each U-shaped wood support member, are encircled with wrapping material by rotation of the wrapping support member holding a roll of wrapping material by the rotation device.

2. The firewood bundler device of claim 1, wherein the rotation device includes a motor member and drive mechanism operatively connected to the wrapping support member.

3. The firewood bundler device of claim 2, further including a foot control switch for controlling operation of the motor member and drive mechanism.

4. The firewood bundler device of claim 1, wherein the rotation device includes a handle attached to the rotation device.

5. The firewood bundler device of claim 1, wherein the spindle section includes a spring and nut assembly adapted for imparting tension on the roll of wrapping material.

* * * * *